US006053853A

United States Patent [19]

Hinds

[11] Patent Number: 6,053,853

[45] Date of Patent: Apr. 25, 2000

[54] PHYSICAL TRAINING WHEEL

[76] Inventor: Jon Hinds, 1211 Rutledge St. #5, Madison, Wis. 53703

[21] Appl. No.: 09/191,411

[22] Filed: Nov. 12, 1998

[51] Int. Cl.[7] ..... A63B 21/00

[52] U.S. Cl. ..... 482/132; 482/79; 280/205; 446/448

[58] Field of Search ..... 482/66, 68, 79, 482/80, 131, 132, 141, 148; 280/29, 205; 446/448

[56] References Cited

U.S. PATENT DOCUMENTS

| | | | |
|---|---|---|---|
| 3,403,906 | 10/1968 | Burzenski | 482/132 |
| 3,580,569 | 5/1971 | Wilson | 272/60 |
| 4,595,197 | 6/1986 | Hagstrom et al. | 272/127 |
| 4,856,211 | 8/1989 | Phillips | 36/131 |
| 5,004,229 | 4/1991 | Lind | 272/127 |
| 5,176,595 | 1/1993 | Lind | 482/51 |
| 5,509,831 | 4/1996 | Gelbart | 440/27 |
| 5,816,818 | 10/1998 | Wun | 434/29 |

*Primary Examiner*—Richard J. Apley
*Assistant Examiner*—Tam Nguyen
*Attorney, Agent, or Firm*—Loyd W. Bonneville

[57] ABSTRACT

An exercise wheel comprising means for emplacement of an operator's feet whereby he or she orients the body such that the hands are rigidly placed against the underlying surface and the wheel is alternately projected and retracted so as to exercise certain muscles.

5 Claims, 2 Drawing Sheets

PHYSICAL TRAINING WHEEL

BACKGROUND OF THE INVENTION

1. Field of the Invention

Exercise equipment

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term adjustable connecting strap (32) might be used in one instance but in another, if meaning is otherwise clear from context, expression might be shortened to connecting strap (32) or merely strap (32). Any of those forms is intended to convey the same meaning. The term attach or fasten or any of their forms when so used means that the juncture is of a more or less permanent nature, such as might be accomplished by nails, screws, welds or adhesives. Thus, it is stated herein that the foot emplacement assembly (2) is attached to the axle (12). A connection in which one object is easily removed from another is described by the word emplace, as where it is stated herein that the operator's (100) feet are emplaced in the foot harness (30). Employment of the words connector join or any of their forms is intended to include the meaning of both in a more general way.

The word comprise may be construed in either of two ways herein. A generic term used to describe a given one of a number of specific elements is said to comprise it, thereby characterizing the specific element with equivalency in meaning for the generic term. Thus, adjustable connection means may be said to comprise miniature hook and loop patches (40), meaning that in the particular case, the adjustable connection means are such patches (40). However, the word comprise may also be used to describe a feature which is part of the structure or composition of a given element. Thus, a foot harness (30) may be said to comprise a heel strap (33), meaning that the structure of the foot harness (30) is such as to have the heel strap (33) as a feature of its structure. The meaning in the respective cases is clear from context, however. Accordingly, modifying words to clarify which of the two uses is the intended one seem unnecessary.

The words above, beneath, forward or rearward and root variations thereof are intended to designate the situs of an object described with reference to the orientation of the operator (100) preparing for or undertaking exercise. Thus, when the arch of the operator's (100) foot is discussed in terms of being disposed more forward or rearward of the axle (12), reference is intended to be consistent with the direction the operator (100) faces when positioning the foot.

Numerous exercise devices have emerged during the past century and particularly during recent decades. The fascination of many with physical conditioning and improvement have driven inventors to conjure up devices which tend to develop musculature and sense of well being differently than had been done before.

The notion that one might benefit in exercise by bearing down upon a moving wheel and axle assembly (1) with the arms and hands relying only upon the feet or knees upon an underlying surface (200) as additional body support was revealed in U.S. Pat. No. 3,403,906 issued to Burzenski and is now well recognized. More recently, interest has turned to creating an instrument upon which an operator (100) bears the feet while supporting the body upon the arms or hands placed rigidly against the underlying surface (200). With such a device, the lower body can be made to undergo contortions while the wheel is alternately—that is, repeatedly—projected and retracted. The supporting members of the body benefit from such exercise as well. Inclusion of elements to support the feet and connect them to the wheel may be expected to vary considerably. Particularly beneficial would be a reasonably sturdy footrest (20).

Several unicycle designs have been developed, all of which comprise rotational pedals offset from the wheel's (11) center. Such pedals are required to turn the wheel (11) by cranking it (11) to undergo revolutions. That activity provides the unicycle locomotion and the operator (100) muscular knee pumping exercise much in the manner a bicycle does. Such muscular activity does not address the musculature exercise needs discussed supra, however. Examples of such devices are found in U.S. Pat. No. 5,509,831 issued to Gelbart; U.S. Pat. No. 5,816,817 issued to Wun; U.S. Pat. No. 3,580,569 issued to Wilson;

U.S. Pat. No. 5,176,595 issued to Lind, U.S. Pat. No. 5,004,229 issued to Lind and U.S. Pat. No. 4,595,197 issued to Hagstrom et al comprise variants of an assembly which provides at least some of the type of exercise sought after supra, but rely upon two wheels (11), a footrest (20) disposed between them (11). While many beneficial exercises of the sort under consideration herein may be performed with that device, the presence of the second wheel (11), altogether aside from the matter of increased manufacturing cost, prevents tilting or canting of either of the wheels (11) so as to steer the mechanism in a path curved to one side or the other. Highly beneficial would be a configuration which does permit such maneuvers, thereby adding an additional class of muscular torsion exercises for the body.

The needs or objectives pointed out supra thus far remain only partly addressed in the prior art. Some, such as that just immediately addressed, have not been met at all.

SUMMARY OF THE INVENTION

The invention is an exercise wheel assembly comprising a wheel and axle assembly (1) comprising but a singular wheel (11) and a pair of foot emplacement assemblies (2). Each of the latter comprises a footrest (20) and foot harness (30), comprising in turn a forestrap (31), an adjustable connecting strap (32) and a heelstrap (33), all of which prevent dislodgement of the operator's feet during exercise. To engage in exercise, the operator (100) places his (100) or her (100) feet in the foot emplacement assemblies (2) and positions the body such that it is supported by placing the hands rigidly against the underlying surface (200). The body is then suspended from the surface (200) with underlying support only through the hands and the wheel-bound feet. The wheel (11) is alternately projected and retracted by thrusting the legs and lower torso outward and withdrawing them inward. The operator (100) may engage in a number of exercises including some in which the wheel (11) is tilted or canted to some degree allowing it (11) to trace out a curved path.

BRIEF DESCRIPTION OF THE DRAWINGS

Solid lines in the drawings represent the invention. Dashed lines represent noninventive material.

extends laterally and the heelstrap (33) hangs loosely.

DESCRIPTION OF THE PREFERRED EMBODIMENT

Figure 1:
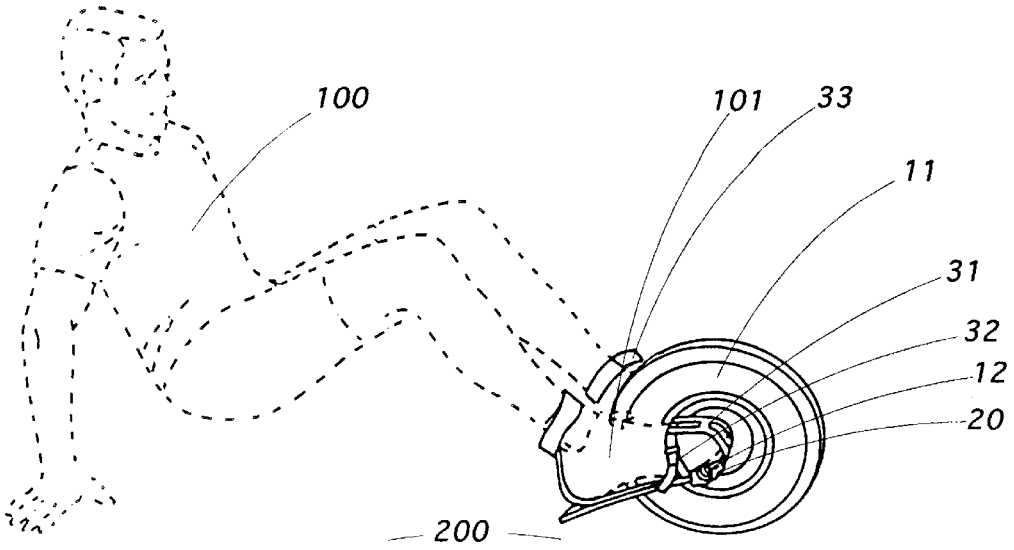
FIGS. 1, 2 and 3 illustrate three exercise postures with which the exercise assembly may be employed.

The subject of this application is an exercise wheel assembly comprising a wheel and axle assembly (1) and a pair of foot emplacement assemblies (2).

The wheel and axle assembly (1) is well known to prior art and comprises in turn the familiar wheel (11) and axle (12).

The wheel itself (11), known even to ancient art and sometimes characterized as civilization's first invention of real significance, is essential to the assembly. Comprising the familiar generally disk-like shape, it rolls along its (11) edge In operation. For optimum efficiency, it (11) should be perfectly round circumferentially. Wheels (11) of various configurations are commercially plentiful and one (11) such as that (11) employed upon a wheelbarrow—either solid or inflated—serves the intended purpose well.

The term "wheel" (11) itself infers that a rotating axle (12) is axially—or transversely—disposed at its (11) center and, although other wheel (11) and axle (12) combinations are extant, such as those employed in cam-like operation, central axle (12) configuration is that required herein. Unless the wheel (11) is deliberately tilted during exercise, ante, the axle's (12) orientation generally remains parallel the plane of the underlying surface (200).

The axle's (12) rotation is most commonly known in prior art to result from allowing it (12) to rotate—or spin—upon bearings, spherically or otherwise smoothly shaped. Such is also the disposition herein. The bearings are preferably seated within the disk of the wheel (11).

Because of the manner of which the exercise assembly is employed, ante, it is necessary that the wheel (11) be of sufficient size to allow the operator's (100) feet to clear the underlying surface (200) during exercise. As explained ante, the axle (12) is preferably seated just beneath the foot's arch to a greater or lesser degree proximate the midportion thereof. Consequently, the optimum diameter of the wheel (11) must exceed the length of the operator's (100) foot. The invention, of course, may be used by children as well as adults and it is feasible that a variety of wheel (11) sizes be incorporated in manufacture. Preferably, the wheel's (11) diameter, therefore, varies between six and 15 inches.

An opposing pair of foot emplacement assemblies (2) are attached to the axle (12), one (2) on each side of the wheel (11). By reason of their (12) attachment, they (2) are permitted to spin axially only as the axle itself (12) does so. Although in use, the wheel (11) and axle (12) spin relative to one another (11, 12), no rotation of the axle (12) relative to the operator (100) is perceived. Rather, it is the wheel itself (11) which is perceived to rotate as it (11) rolls along on its (11) edge upon the underlying surface (200). The operator's (100) feet, mounted within the emplacement assemblies (2) necessarily remain fixed with reference to the axle (12).

Figure 2:
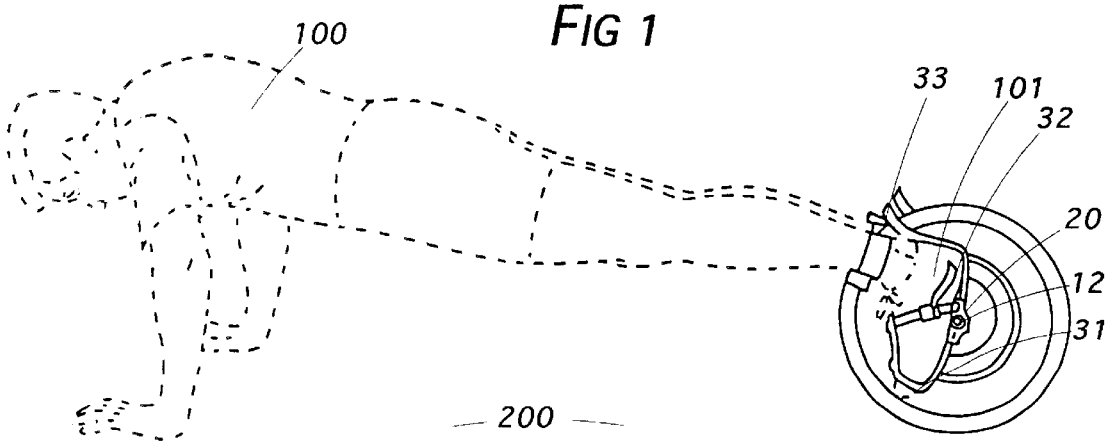
Figure 3:
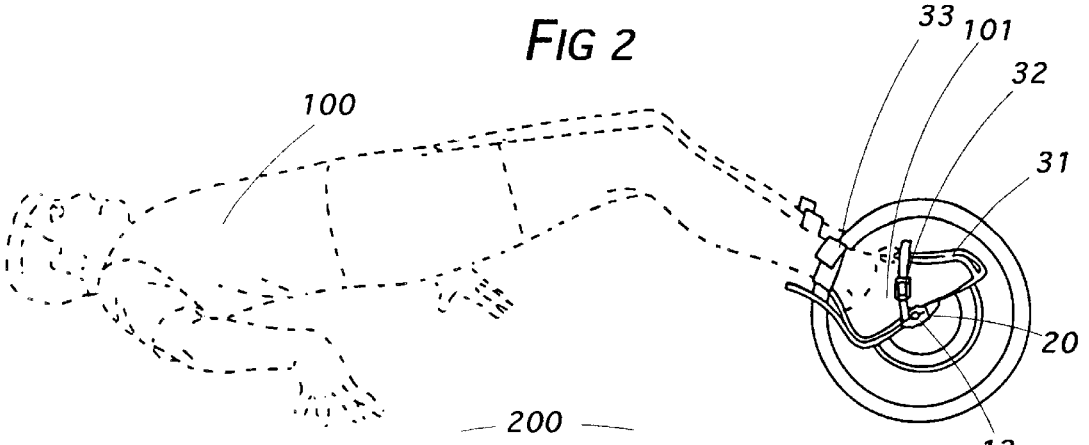

The emplacement assemblies (2) may, thus, be attached in a manner which would dispose the operator's feet above, below, forward of or rearward of the axle (12). Experience dictates, however, that configuring the assembly such that the arch of each of the operator's (100) feet seat upon the axle (12) in the manner illustrated in FIGS. 1 and 2 is preferred. FIG. 3, however, depicts the arch of each of the operator's (100) feet disposed slightly rearward such that the axle (12) is seated more nearly beneath the toes. Again, FIG. 2 shows the toes protruding between a portion of the straps such that the arch of the foot is disposed slightly forward relative to the axle (12). Such foot emplacement variations are accomplished merely by adjusting the straps, ante.

The part of the foot emplacement assembly (2) against or upon which each of the operator's (100) feet are supported is a footrest (20), comprising sufficient rigidity for such purpose during exercise. It (20) may be configured merely as a bicycle pedal, such as indicated in FIGS. 2–7, since experience has aptly demonstrated its reliability for similar purposes. Although a bicycle pedal is known generally to rotate separately upon an axle (12), very little of such rotation occurs during exercise because the spinning locus is necessarily disposed at the point the axle (12) and wheel (11) interengage, supra. Any incidental rotation which might occur between a footrest (20) comprising in part a bicycle pedal and the axle (12) is not detrimental to the assembly's operation but actually beneficial in permitting some play in movement. If a bicycle pedal is so employed, it may be attached so as to prevent rotation.

Each foot emplacement assembly (2) further comprises a foot harness (30) which, following emplacement of the operator's (100) feet, is disposed to partially enwrap the foot and lower leg in a manner to obviate dislodgement. The foot harness (30) comprises an array of straps disposed in configuration for such purpose.

Figure 4:
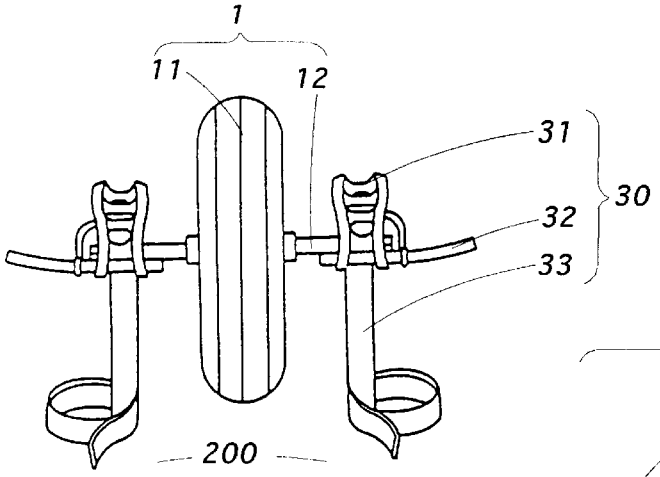
FIG. 4 represents a frontal view of the invention, in which the forestrap (31) of the foot harness (30) extends toward the viewer, the first end of the adjustable connecting strap (32)
Figure 5:
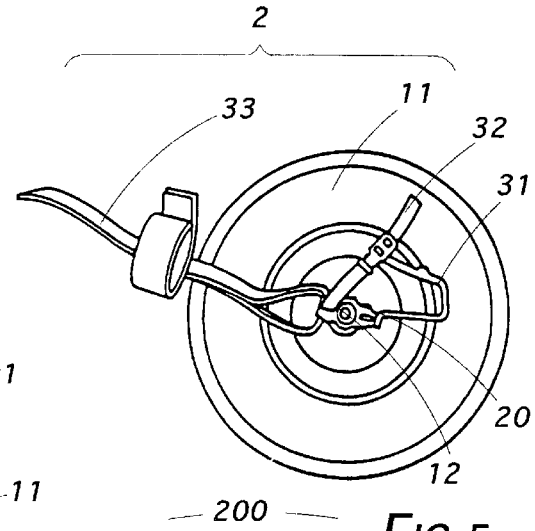
FIG. 5 comprises a side view thereof.
Figure 6:
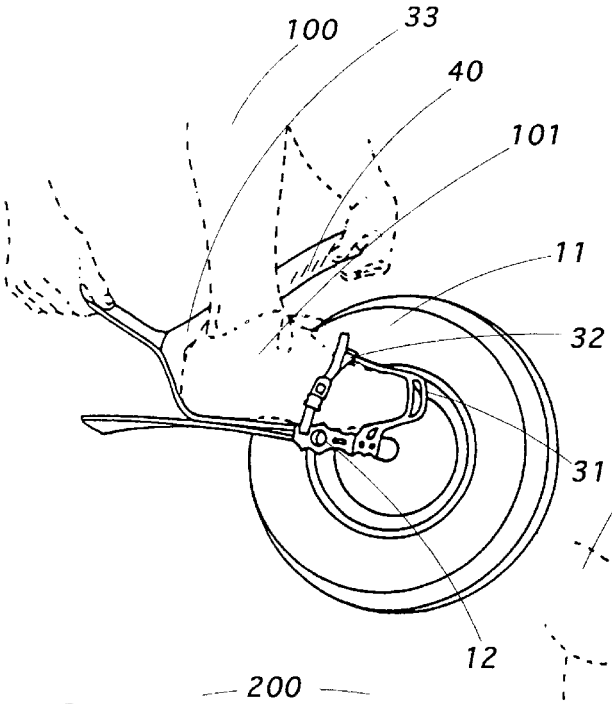
FIGS. 6 and 7 comprise perspective views of an operator (100) adjusting the invention's heelstrap (33) and depict a bicycle pedal as a footrest (20).
Figure 7:
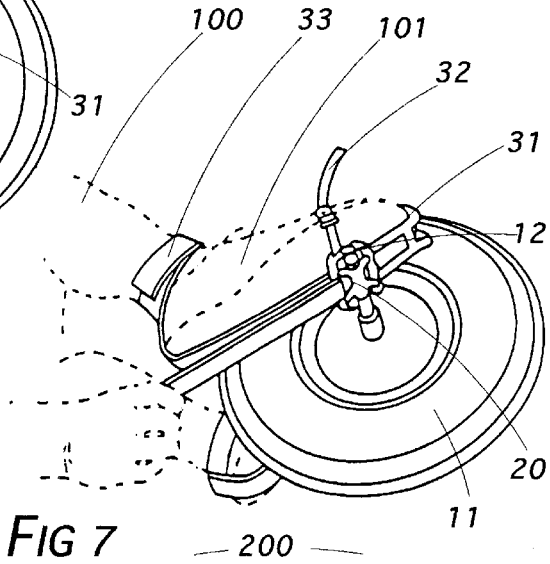

The forestrap (31) of the strap pattern is disposed at the foremost part of the foot harness (30) and embraces the foremost part of the foot. This is depicted with particularity in FIGS. 4–7, wherein a pair of straps extend along the top of the foot in generally parallel fashion, join for cross-bracing part way along their length and then loop at their first ends such that a transversely disposed adjustable connecting strap (32) may be passed through them. The forestrap (31) is so disposed that it prevents the operator's (100) foot from advancing beyond a predetermined point. As alluded to supra, the harness (30) may be adjusted so as to permit the toes to extend forward between a portion of the forestrap (31) as illustrated in FIG. 5.

A heel strap (33) extends longitudinally backwards under the foot and passes behind the heel, extending upwards and terminating at a first end in a T-shaped configuration disposed to circumferentially enwrap the operator's (100) lower leg just above the ankle.

While any traditional means may be employed to secure the straps in place upon the operator (100), miniature hook and loop patches (40)—that is, the Velcro® variety—are preferred. Thus, the opposing faces of the T-shaped terminus of the heel strap (33) upon enwrapment are preferably so configured. The adjustable strap (32) may also comprise such adjustable connecting means at its first end, although it is equally preferable that it comprise a sliding friction clamp of the well known sort employed on backpacks and book bags.

Although miniature hook and loop patches (40) may also be employed to anchor a second end of the straps (31, 32 and 33, respectively) to the footrest (20) or the axle (12), attaching means are preferable for such purpose. Attachment may be accomplished by any known means including looping or reeving the anchoring end of the strap around a part of the foot emplacement assembly (2) and sewing the strap (31, 32 and 33, respectively) back upon itself. The heel strap (33) of FIG. 4 is shown such that miniature hook and loop patches (23) may be the securing means between the opposing strap (24) faces.

In use, the operator (100) may be positioned in any of a number of selected positions. FIGS. 1–3 depict three of them.

In all, the operator (100), having secured his (100) or her (100) feet within each foot harness (30), orients the body such that the hands are rigidly placed against the underlying surface (200). The legs and lower torso are then alternately projected—or thrust—forward away from the body and then retracted—or withdrawn—backward toward it. In response, the wheel (11) rolls forward and backward upon the surface (200). It should be readily apparent that the operator's (100) feet in each case remain fixed in position with reference to the wheel's axle (12) which during exercise, spins at its locus of engagement with the wheel (11). Each of the three positions illustrated, merely exemplary for purposes of this application, exercise different muscles of the body.

As a further muscular variation, the operator (100) may elect to tilt the wheel (11) to a selected degree so as to thrust the assembly somewhat laterally, causing the path of the wheel (11) to curve to one side or the other. Any of the three orientations shown permit such a variation.

The inventor hereby claims:

1. An exercise wheel assembly comprising:

a wheel and axle assembly; and a pair of foot emplacement assemblies;

the wheel and axle assembly comprising a wheel and axle wherein the axle is disposed axially at the wheel's center;

each of the foot emplacement assemblies attached to the axle, disposed in opposition to one another, one on each side of the wheel, and comprising a footrest and a foot harness; the foot harness comprising:

a forestrap;

an adjustable connecting strap; and a heelstrap;

the forestrap disposed at the foremost part of the foot harness and comprising one or more loops at a first end and attached at a second end to one of the footrest and axle;

the adjustable connecting strap disposed to pass through the loops of the forestrap and comprising adjustable connecting means at a first end and attached at a second end to one of the footrest and axle;

the heelstrap disposed to extend longitudinally backwards beneath an operator's foot, pass behind the heel, extend upwards and terminate at a first end in T-shaped configuration comprising adjustable connecting means and disposed to circumferentially enwrap an operator's lower leg; and attached at a second end to one of the footrest and axle;

whereby an operator may, upon emplacing his or her feet in the foot harness, engage in a number of selected exercises wherein the hands are held rigidly against the underlying surface and the assembly is alternately projected and retracted to exercise certain muscles.

2. The exercise wheel assembly according to claim 1 wherein the footrest comprises a bicycle pedal.

3. The exercise wheel assembly according to claim 1 wherein the adjustable connecting means of the adjustable connecting strap and heelstrap comprise miniature hook and loop patches.

4. The exercise wheel assembly according to claim 1 wherein the wheel is inflated.

5. The exercise wheel assembly according to claim 1 wherein the wheel comprises a diameter within a range between six inches and 15 inches.

* * * * *